US005863232A

United States Patent [19]

Lee

[11] Patent Number: 5,863,232

[45] Date of Patent: Jan. 26, 1999

[54] FABRICATION METHOD OF MICRO TIP FOR FIELD EMISSION DISPLAY DEVICE

[75] Inventor: Seok Soo Lee, Kyungsanbook-Do, Rep. of Korea

[73] Assignee: LG Semicon Co., Ltd., Cheongju, Rep. of Korea

[21] Appl. No.: 745,290

[22] Filed: Nov. 8, 1996

[30] Foreign Application Priority Data

Nov. 20, 1995 [KR] Rep. of Korea ..... 1995/42227

[51] Int. Cl.[6] ..... H01J 9/02

[52] U.S. Cl. ..... 445/24; 445/50; 216/11; 216/24; 216/41; 216/87

[58] Field of Search ..... 445/24, 50, 51; 216/11, 24, 41, 87

[56] References Cited

U.S. PATENT DOCUMENTS

| | | | |
|---|---|---|---|
| 4,763,187 | 8/1988 | Biberian | 358/56 |
| 5,277,638 | 1/1994 | Lee | 445/24 |
| 5,420,054 | 5/1995 | Choi et al. | 437/38 |
| 5,505,649 | 4/1996 | Park | 445/50 |
| 5,532,177 | 7/1996 | Cathey | 437/40 |
| 5,628,661 | 5/1997 | Kim et al. | 445/24 |

*Primary Examiner*—Matthew V. Grumbling
*Attorney, Agent, or Firm*—Fleshner & Kim

[57] ABSTRACT

A method for making a micro tip of an FED device includes the steps converting impurity layer regions into porous semiconductor layer regions by performing an anodic reaction using an HF aqueous solution as an electrolytic solution, oxidizing the porous silicon layer regions, and removing the oxidation layer by etching with HF aqueous solution. The shape of the fabricated micro tip is regular and precise, since the size and height of the micro tip are easily controlled. Hence, the size and direction of an electron beam emitted from the micro tip is regular, and a reliability of the FED device is enhanced.

15 Claims, 2 Drawing Sheets

FABRICATION METHOD OF MICRO TIP FOR FIELD EMISSION DISPLAY DEVICE

TECHNICAL FIELD

The present invention relates to a fabrication method of a micro tip for a field emission display device (hereinafter, called an FED device) and in particular, to an improved fabrication method of a regular and precise micro-tip for an FED device.

BACKGROUND ART

Conventionally, an FED device is operated by a vacuum microelectronic technique which is based on an electron transmission in a vacuum condition. Since the FED device employs an FED phenomenon by a quantum dynamic tunneling, less electricity is consumed. The emitted current, which flows in a vacuum from a cathode, reaches up to tens of $cm^2$, and the size of the FED device is only several $\mu$m. Such a relationship allows a mass production using a semiconductor fabrication process and an integration with an electronic circuit.

FIG. 1 is a longitudinal cross-sectional view showing a cell, which is a main unit in a general FED device. As shown in this view, a plurality of columns of cathodes 2, which emits electrons, are arranged on a glass substrate 1. At the upper part of each cathode 2, micro tips 2*a,* each having a conical shape, are formed at a regular interval. When the cathode 2 is supplied with power, an electron beam is emitted upwardly from the points of each micro tip 2*a* in the vertical direction.

Gates 3 are arranged in an array to intersect with the cathodes 2 between each micro tip 2*a* of the cathodes 2. Insulating layers 4 are disposed between the cathodes 2 and the gates 3 at the intersecting sections thereof so that the cathodes 2 and the gates 3 are separated from each other. The gate 3 formed on the insulating layer 4 prevents an electron beam emitted from the point of the micro tip 2*a* from being diffused or being curved, and allows a regular and constant electron beam to go in the upper vertical direction. On the upper part of the gate 3, a spacer 5 is formed to surround a cell area, and has an opening in its center.

A fluorescent body 6, having a planar construction and a fluorescent material, is formed on the spacer 5 so as to cover the opening part of the spacer 5. An electron beam emitted from the micro tip 2*a* collides with the fluorescent body 6, causing the fluorescent material to become excited and emit light by fluorescence. On the fluorescent body 6 is formed a transparent anode 7 having a planar construction, which is capable of transmitting light and inducing electrons to flow to the fluorescent body 6 by generating an electric field. The anode 7 is entirely covered with a glass substrate 8.

FIGS. 2A through 2C are cross-sectional views showing the fabrication method for a micro tip according to a conventional art. First, as shown in FIG. 2A, an oxide film 13 is formed by a oxidation process on an n-type or a p-type silicon substrate 11. Next, as shown in FIG. 2B, an oxide film pattern related to the region for the formation of the micro tip 12 is formed on the oxide film by a photo etching process, and the substrate 11 is etched using the oxide film pattern as a mask.

The wet-etching of the substrate 11 is carried out with a solution including Potassium Hydroxide (KOH) as a base, and Hydrogen Peroxide ($H_2O_2$) and Isopropyl Alcohol ($CH_3CHOHCH_3$) mixed therewith. In this wet-etching process, the conical shape of the micro tip 12 is fabricated by using as a mask the oxide film 13 patterned by the photo etching process, employing an anisotropic etching characteristic of the above etching solutions, and controlling a concentration of the etching solutions and an etching time. The fabrication process is completed by stripping the oxide film 13 which remains on the points of the micro tips 12, by an etching process using Hydrogen Fluoride (HF).

The above-mentioned fabrication method of the conventional micro tip 12 includes forming the oxide film 13 on the silicon substrate 11, forming a pattern on the oxide film 13 by a photo etching process, forming a shape of the micro tip 12 by etching the silicon substrate 11 on which the oxide film 13 is formed with an etching solution having an anisotropic etching characteristic, and stripping the oxide film 13 which remains on the points of the micro tips 12.

The conventional micro tip fabricated by the above described steps is disadvantageous since the micro tip cannot be formed with a desired conical shape. For example, a central axis of a conical-shaped tip is not formed as a straight line, or a shape of the tip is formed as a polygon, not as a precise conical shape. In addition, since the height of each tip is formed irregularly and the distribution of the electric field is not regular, a screen image, in which an FED device is employed, is not formed clearly. As a result, the durability of the FED device is shortened, and it is difficult to control an etching ratio for forming a desirable shape of a micro tip.

DISCLOSURE OF THE INVENTION

An advantage of the present invention is in forming micro tips with precise shape.

Another advantage of the present invention is in regular distribution of regular electric field.

Another advantage of the present invention is in increasing the durability of an FED device.

The above advantages and others are achieved at least in part by the method of making a micro tip, comprising the steps of: forming a plurality of impurity regions in a semiconductor substrate; converting the impurity regions into a plurality of porous regions; oxidizing the plurality of porous regions into a plurality of oxidation region; and removing the oxidation regions.

The present invention is also achieved at least in part by a method for making a micro tip of an FED device comprising the steps of: forming an insulative film on a semiconductor substrate; removing prescribed portions of the insulative film to form a pattern; depositing an impurity into the substrate using the patterned insulative film as a mask to form a plurality of impurity layer regions; removing the patterned insulative film; converting the impurity layer regions into porous semiconductor layer regions; oxidizing the porous semiconductor layer regions; and removing the oxidation layer regions.

Additional advantages, objects and other features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

BEST MODE FOR CARRYING OUT THE INVENTION

Figure 1:
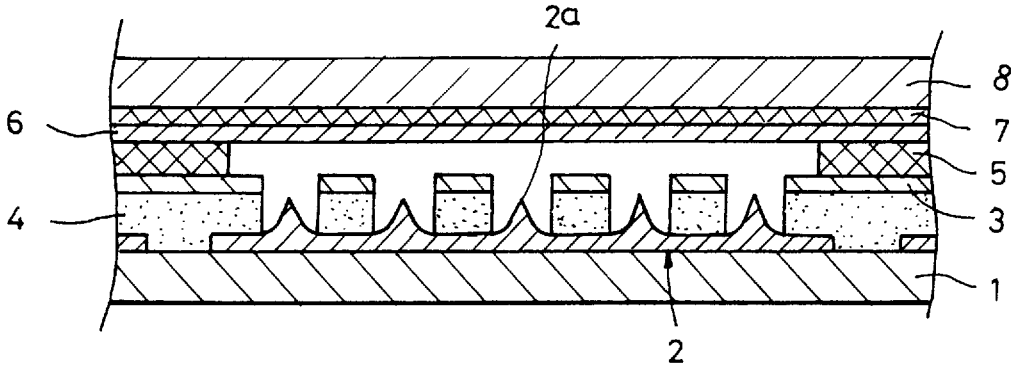
FIG. 1 CONVENTIONAL ART
FIG. 1 is a longitudinal cross-sectional view of an FED device according to the conventional art.
Figure 2A:
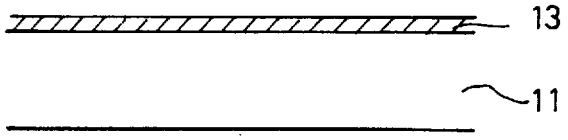
FIG. 2A CONVENTIONAL ART
FIGS. 2A through 2C are cross-sectional views of a fabrication method for a micro tip according to the conventional art.
Figure 2B:
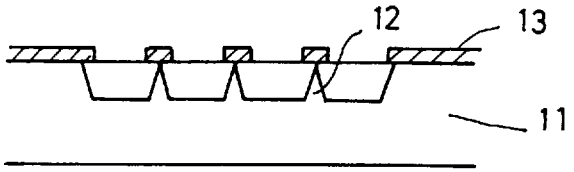
FIG. 2B CONVENTIONAL ART
Figure 2C:
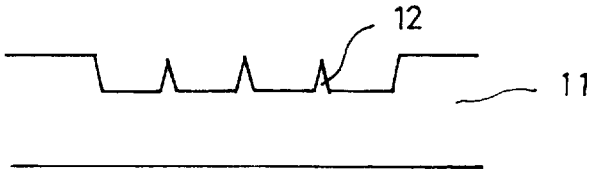
FIG. 2C CONVENTIONAL ART
Figure 3A:
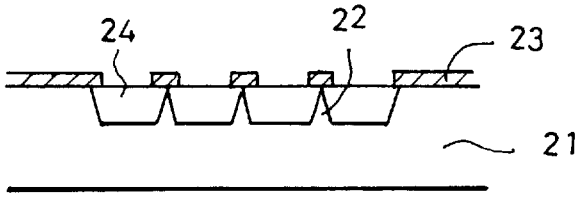
FIGS. 3A through 3D are cross-sectional views of a fabrication method for a micro tip according to the present invention.

FIGS. 3A through 3D are cross-sectional views of a fabrication method according to the present invention. First, as shown in FIG. 3A, an oxide film 23 is formed on an n-type silicon substrate 21, and a pattern of the oxide film 23 is formed which is related to the regions for the formation of micro tips 22 using a photo etching process. Then, a p-type impurity layer 24 is formed by diffusing a high density p-type impurity layer into the substrate 21 using the patterned oxide film 23 as a mask.

Here, the step for forming the pattern of the oxide film 23 and the step for forming the impurity layer 24 by diffusing a high density p-type impurity into the silicon substrate 21 are the processes for forming a rough micro tip 22. The impurity layer 24 formed in the silicon substrate 21 forms a rough conical-shaped micro tip 22 at the region located under the pattern of the oxide film 23, which is used as a mask by controlling a diffusion speed and direction of the impurity. The conical-shaped region is a region into which the impurity is not infiltrated, and the composing material is the same n-type silicon material as that of the substrate 21.

Figure 3B:
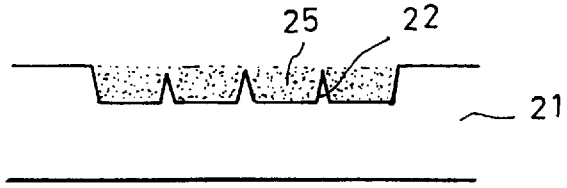

As shown in FIG. 3B, the pattern of the oxide film 23, which is used as a mask in the impurity diffusion process, is stripped. Only the high concentration p-type impurity layer 24 is selectively formed to be a porous silicon layer (PSL) 25 by performing an anodic reaction using an HF solution as an electrolytic solution in a tube. The porous silicon layer 25 is formed by an electrochemical reaction occurring in the boundary surface of the silicon and the HF solution, and the formation thereof will be described in detail.

First, a wafer, which serves as the silicon substrate 21, is placed in the center of the tube, and the tube is filled with HF solution from both sides of the wafer, using the wafer as a diaphragm. When a positive electrical pole is applied to one side, in which the impurity layer 24 in the substrate 21 is formed, and a negative electrical pole is applied to the other side, a silicon is dissolved on the boundary surface of the silicon and the HF solution in accordance with an anodic reaction and pores are formed. Since the impurity-infiltrated silicon layer (that is, the impurity layer 24) is anodic-reacted at a higher speed than the silicon substrate composed of a single crystal, the impurity-infiltrated silicon layer 24 is selectively formed to be the porous silicon layer 25.

As a reference, a chemical reaction on the boundary surface of the silicon and the HF solution which occurs in accordance with the electric field applied in the anodic reaction is as follows. The formula (1) is an initial reaction formula and as the reaction time elapses, such a reaction as the formula (2) leads to an anodic reaction.

$$Si+2HF+(2-n)h+\rightarrow SiF_2+2H^++ne^-SiF_2+2HF\rightarrow SiF_4+H_2\uparrow(n<2) \quad (1)$$

$$Si+4HF+(4-m)h^+\rightarrow SiF_4+4H^++me^-SiF_4+2HF\rightarrow H_2SiF_6\ (m<2) \quad (2)$$

Here, $h^+$ and $e^-$ represents a hole and an electron which relate to the reaction, and n and m represent reaction coefficients. Here, the number of holes needed in separating one silicon atom is called an effective dissolution value, which is known as 2~2.8.

Referring to FIG. 3B, the silicon substrate 21 excluding portions of the impurity layer 24 serves as a mask in the anodic reaction, and the electrolytic solution used in the anodic reaction is 20~49 wt % of an HF aqueous solution. Since the porous silicon layer 25 has a low cohesive force at the surface, the layer 25 is oxidized at a rate thousands of times higher than the substrate 21 composed of a single crystalline silicon.

Figure 3C:
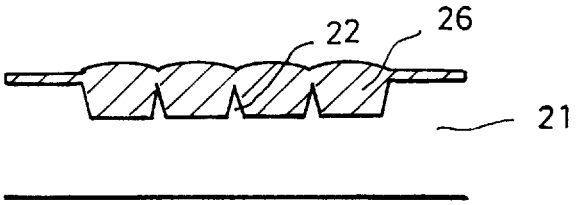
Figure 3D:
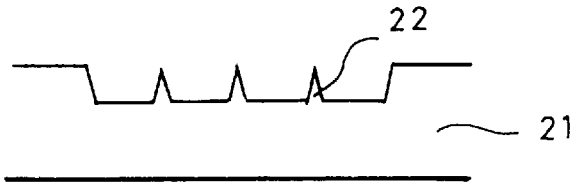

Therefore, as shown in FIG. 3C, when the silicon substrate in which the porous silicon layers 25 are formed is oxidized at a high temperature, since the porous silicon layer 25, excluding portions of the n-type silicon substrate 21 is formed to be an oxide layer 26, the rough conical-shaped micro tip 22 is formed to be regular and precise. A dry oxidation process and a wet oxidation process are performed sequentially, and the temperature in an oxidation process of the porous silicon layer 25 is about 850° C.~1100° C. and the reaction time is 30 minutes to 2 hours. Next, by etching the oxide layer 26 with an HF solution, as shown in FIG. 3D, the oxide layer 26 is stripped and thereby the shape of the micro tip is formed to be regular and precise.

According to the fabrication method for a micro tip of the present invention, since the size and height of the micro tip are easily controlled, the shape of the micro tip is regular and precise. Therefore, the size and direction of an electron beam emitted from the micro tip is regular, and the reliability of the micro tip is enhanced. In addition, a shortening of the durability of the FED device caused by the irregular shaping of the micro tip 22 is prevented. The process is performed in a fabrication method simpler and easier than the conventional fabrication method using an anisotropic etching solution, and a high integration of an FED device is achieved.

Although the preferred embodiments of the present invention have been disclosed for illustrative purposes, those skilled in the art will appreciate that various modifications, additions and substitutions are possible, without departing from the scope and spirit of the invention as recited in the accompanying claims.

I claim:

1. A method for making a micro tip of an FED device comprising the steps of:

forming an insulative film on a semiconductor substrate;

removing prescribed portions of said insulative film to form a pattern;

depositing an impurity into the substrate using the patterned insulative film as a mask to form a plurality of impurity layer regions;

removing the patterned insulative film;

converting the impurity layer regions into porous semiconductor layer regions;

oxidizing the porous semiconductor layer regions into a plurality of oxidation layer regions; and removing the plurality of oxidation layer regions.

2. The method of claim 1, wherein a conical shape of a micro tip is formed in the semiconductor substrate between adjoining impurity layer regions located under the pattern of the insulative film, which is used as a mask, by controlling a diffusion speed and direction of the impurity.

3. The method of claim 1, wherein said impurity layer is converted to the porous silicon layer regions by carrying out an anodic reaction using an HF aqueous solution as an electrolytic solution.

4. The method of claim 3, wherein said semiconductor substrate is used as a mask, except for the impurity layers therein, when the anodic reaction is carried out.

5. The method of claim 3, wherein said electrolytic solution is 20~49 wt % of an HF aqueous solution.

6. The method of claim 1, wherein said oxidation process of the porous silicon layer regions is carried out under the condition that the temperature is about 850° C.~1100° C. and the reaction time is 30 minutes to 2 hours, and a dry oxidation process and a wet oxidation process are performed sequentially.

7. The method of claim 1, wherein said patterned insulative film is formed by a photo etching process.

8. The method of claim 1, wherein said oxidation layer regions are wet-etched with an HF aqueous solution.

9. The method of making a micro tip, comprising the steps of:

forming a plurality of impurity regions in a semiconductor substrate;

converting the impurity regions into a plurality of porous regions;

oxidizing said plurality of porous regions into a plurality of oxidation regions; and removing the plurality of oxidation regions.

10. The method of claim 9, wherein said step of forming said plurality of impurity regions comprises:

forming an oxide layer on the semiconductor substrate;

removing prescribed portions of said oxide layer to form a pattern;

diffusing an impurity into said semiconductor substrate as a mask; and removing the patterned oxide layer.

11. The method of claim 9, wherein said step of converting comprises the step of performing an anodic reaction using an HF aqueous solution as an electrolytic solution.

12. The method of claim 11, wherein said electrolytic solution is about 20 to 49 weight % of an HF aqueous solution.

13. The method of claim 11, wherein said anodic reaction is performed under a temperature of about 850° C.~1100° C. and a reaction time of approximately 30 minutes to two hours.

14. The method of claim 9, wherein said oxidation step comprises:

a dry oxidation and a wet oxidation performed sequentially.

15. The method of claim 9, wherein said step of removing said oxidation layers comprises wet etching with an HF aqueous solution.

* * * * *